US005993112A

United States Patent [19]

Neal

[11] Patent Number: 5,993,112

[45] Date of Patent: Nov. 30, 1999

[54] FLOATING RESERVOIR COVER TENSIONING SYSTEM

[76] Inventor: Charles C. Neal, 8625 Argent St., Santee, Calif. 92071

[21] Appl. No.: 09/024,439

[22] Filed: Feb. 17, 1998

[51] Int. Cl.[6] ..... B65G 5/00

[52] U.S. Cl. ..... 405/52; 242/372; 4/498

[58] Field of Search ..... 405/52, 53, 55, 405/60; 242/372, 376, 380, 422.1, 919; 254/364; 4/498, 503, 502, 500, 494, 495

[56] References Cited

U.S. PATENT DOCUMENTS

| | | | |
|---|---|---|---|
| 3,156,431 | 11/1964 | Zivi | 242/372 |
| 3,815,367 | 6/1974 | Collins et al. | 405/52 |
| 5,108,225 | 4/1992 | Neal | 405/52 |

*Primary Examiner*—David Bagnell
*Assistant Examiner*—Frederick Lagman
*Attorney, Agent, or Firm*—Charles C. Logan III

[57] ABSTRACT

A floating reservoir cover tensioning system that eliminates unsightly towers that are mounted on the upper surface of the surrounding containing walls of a reservoir. A plurality of tensioning assemblies are mounted in cases supported on the top surface of the surrounding containing wall of the reservoir at predetermined spaced intervals to assure that the tension forces are equally distributed. Each of the tensioning assemblies has a combined structure of a cable drum and a storage drum journaled on a bearing extending up from a mounting plate. A pair of laterally spaced spring motor drums are also journaled on their respective bearings extending up from the mounting plate. One end of a first coiled-band spring is secured to one of the spring motor drums and its opposite end is secured to the storage drum. A second coiled-band spring has its one end secured to the second motor drum and its other end secured to the storage drum. A plurality of cables each have their one end secured to one of the respective cable drums and their opposite ends secured to the peripheral edge of the skirt portion of a floating cover for a reservoir.

11 Claims, 1 Drawing Sheet

FLOATING RESERVOIR COVER TENSIONING SYSTEM

BACKGROUND OF THE INVENTION

The invention relates to large liquid containers and more particularly to reservoirs having a floating cover assembly.

Throughout the world the necessity for a pure water supply is essential to sustain the life and health of mankind. Many areas of the world have population concentrations where local water resources cannot support the demands placed on the limited supply. Through the ingenuity of engineers, construction of very complex water transport and storage systems have been successfully implemented to make remote water sources accessible to population centers hundreds of miles away from the water source. Increased demands for the limited water resources continue to challenge engineers for unique solutions to enhance water supplies. Drought weather patterns aggravate the situation where preserving and utilizing the precious resources have become of paramount importance to the government and the populous at large.

In order to conserve water resources, many reservoirs are having floating cover assemblies installed to cut down on evaporation and contamination of the water in the reservoir. There is a great body of prior art with respect to floating reservoir covers and the advantages of and methods for imparting tension into the flexible membrane covers to make them function as desired.

U.S. Pat. No. 3,815,367 teaches a method of imparting tension to the central portion of a floating cover using a plurality of weight towers around the outside of the reservoir. This patent describes what is commercially known as a "mechanically tensioned floating cover". U.S. Pat. No. 4,971,217 principally teaches the use of slip ring connections in the reservoir cover system design. This cover system could employ the tensioning system taught in this patent application. U.S. Pat. No. 5,108,225 teaches the use of a mechanically tensioned floating cover in conjunction with an elevated wall reservoir. This cover system could also employ the tensioning system taught in this patent disclosure.

It is important to note that the present state of the art in commercial practice of mechanically tensioned floating covers universally and exclusively utilize "weight towers" to provide the tensioning means. The use of floating covers for reservoirs has been around for approximately 25 years. The weight towers extending up from the top surface of the surrounding containing wall of the reservoirs are found objectionable for both practical reasons and cosmetic reasons. They appear as a row of numerous four to fourteen foot high posts extending upwardly from the containing wall of the reservoir. Aesthetically, they are objectionable. The individual cost of the numerous towers that are laterally spaced from each other around the periphery of the surrounding containing wall is relatively costly. Added to this is the expense of installing these numerous weight towers. The weight of these towers is also a costly consideration when they have to be shipped to distant installation sites.

It is an object of the invention to provide a novel floating reservoir cover tensioning system that eliminates the unsightly weight towers used in state of the art floating reservoir cover installations.

It is also an object of the invention to provide a novel floating reservoir cover tensioning system that utilizes constant force springs mounted in a low profile case or housing for providing the required tension to the periphery of the floating reservoir cover.

It is another object of the invention to provide a floating reservoir cover tensioning system whose tensioning assemblies are relatively inexpensive to install.

It is a further object of the invention to provide a novel floating reservoir cover tensioning system whose tensioning assemblies are much smaller in size and weigh much less than existing prior art tensioning assemblies.

It is an additional object of the invention to provide a novel floating reservoir cover tensioning system that is more economical to manufacture and market than existing floating reservoir cover tensioning systems.

SUMMARY OF THE INVENTION

The novel floating reservoir cover tensioning system utilizes flat strip reel springs on automatically retractable reels as the primary tension imparting means in place of weight towers such as are presently used. These reel springs are of the constant force spring variety. A constant force spring develops its resisting force by increments rather than cumulatively. Every constant force spring is produced to provide a specific force which is exerted through the entire extension of the spring. The force is constant as long as the radius remains constant. Constant force springs deliver more force per pound of material than gravity devices.

Constant force springs have enormous expandability. Their final load is limited only by the length of the spring material. At all extensions, the load remains the same. The constant force springs provide a strong recoiling force. This force may result in a tendency on the part of the extended material to twist in its effort to regain preset curvature. To inhibit this curling, it is always advisable to engage the front end of the spring in a manner that will not permit turning axially about the line of force. The attachment member must not be free to rotate about that axis.

The drum end and coiled body of the reel springs must be completely free to rotate. No torque load or friction load should be applied to the spool or shaft, as the extended portion must be taken up by the coil readily to maintain full tension.

In the novel floating reservoir cover tensioning system the tensioning assembly are mounted around the perimeter of the reservoir. Optionally they are mounted in a protective weatherproof case or housing made of any appropriate material to keep the spring protected from rain and dirt. In this most basic form each tensioning assembly would have the free end of a cable extending directly out towards the respective points of connection on the flexible floating cover membrane.

The height of the case or housing in which the constant force spring is mounted would normally be less than 8 inches high. This eliminates the unsightly weight towers such as are presently used in the industry. The low profile of the novel case or housing containing the constant force springs are very unobtrusive and barely noticeable. Aesthetically, they are a 1000% improvement.

In addition to the aesthetic advantages, the new system eliminates the costly weight towers, their sheaves, and several bolts required to secure them. Not only is the cost of these components eliminated, the costliness of their having to be shipped to various installation sites has been dramatically decreased. The new profile cases or housings are much lighter in weight. This is a considerable advantage when considering the fact the housings for the constant force springs are located around the entire perimeter of the reservoir at intervals in the range of 3 to 30 feet.

The tensioning assemblies each have a mounting plate having a length L2 in the range of 8–18 inches and a width W2 in the range of 3–10 inches. Laterally spaced from each other on the top surface of the mounting plate is a first spring motor drum and a second spring motor drum. Each is journaled on a bearing shaft extending up from the top surface from the mounting plate.

Positioned between the two spring motor drums is a combination structure having a cable drum stacked on top of a storage drum and interconnected thereto so that they rotate as a single unit. This combination structure is also journaled on a bearing shaft extending up from the top surface of the mounting plate.

A first coiled-band spring formed of a strip of metal has its rear end gripping the first spring motor drum so that it can be coiled thereon and its front end secured to the storage drum so it can be coiled thereon. A second coiled-band spring has its rear end gripping the second spring motor drum so it can be coiled thereon and its front end secured to the storage drum so that it can be coiled thereon. The length of the springs is L1 and L1 is in the range of 1–30 feet. The width of the springs is W1 and W1 is in the range of 1–6 inches.

A cable has its rear end wound on the cable drum with the free end passing through a cable guide structure and then having its front end secured to the skirt portion of the floating cover.

As the level of the water beneath the floating cover recedes, the weight of the cover will pull the cable out of the tensioning assembly housing and this will cause the cable drum to rotate about its vertical axis. Since the storage drum rotates as a single unit with the cable drum, the first and second coiled-band springs will be drawn off of the respective spring motor drums and caused to coil on the storage drum. As the level of the water beneath the cover increases, the reverse action will cause the cable to be drawn back into the housing of the tensioning assemblies and the first and second coiled-band springs will be drawn onto their respective first and second spring motor drums.

DESCRIPTION OF THE PREFERRED EMBODIMENT

Figure 1:
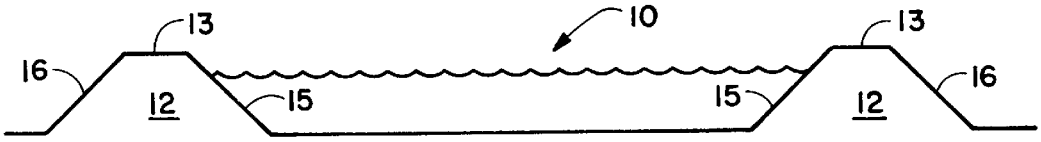
FIG. 1 is a schematic side elevation view of a conventional earthen wall reservoir.

The schematic view of an existing conventional and state of the art reservoir is illustrated in FIG. 1. Reservoir 10 has a periphery defined by the inner faces of a surrounding containing wall 12, commonly called a berm, the berm having a generally horizontal upper surface 13 serving as a walkway. Sloping inner and outer surfaces 15 and 16 extend downwardly from the walkway at angles shown.

Figure 2:
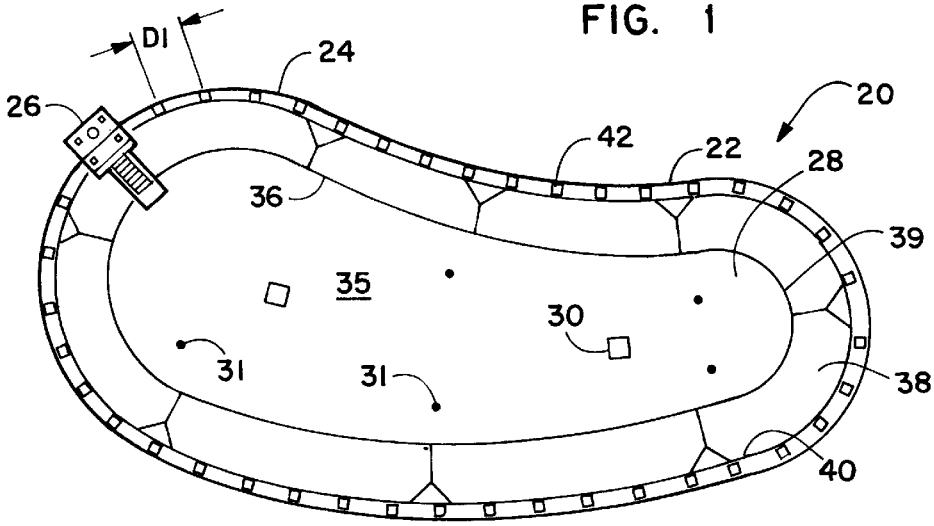
FIG. 2 is a schematic top plan view of the novel floating reservoir cover tensioning system.
Figure 3:
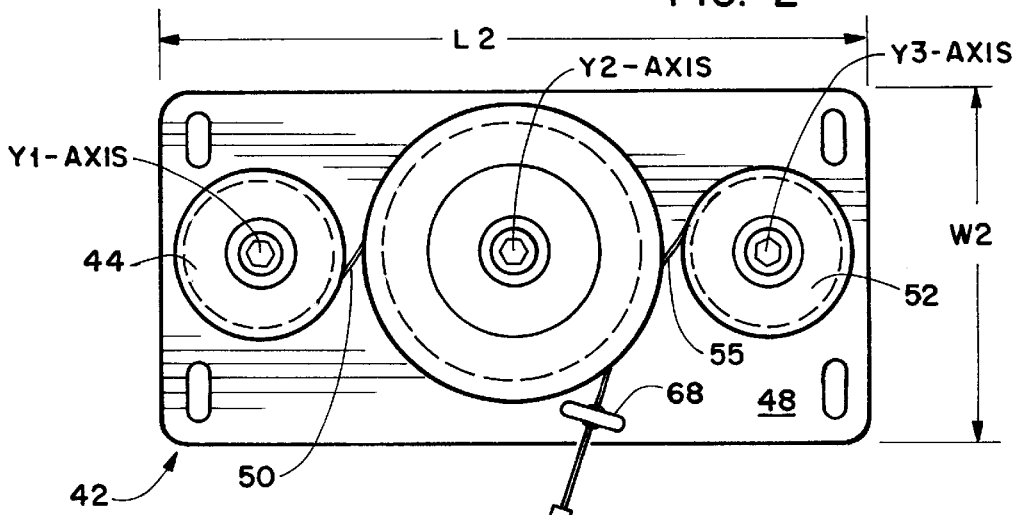
FIG. 3 is a top plan view of the novel tensioning assembly with its cover removed.
Figure 4:
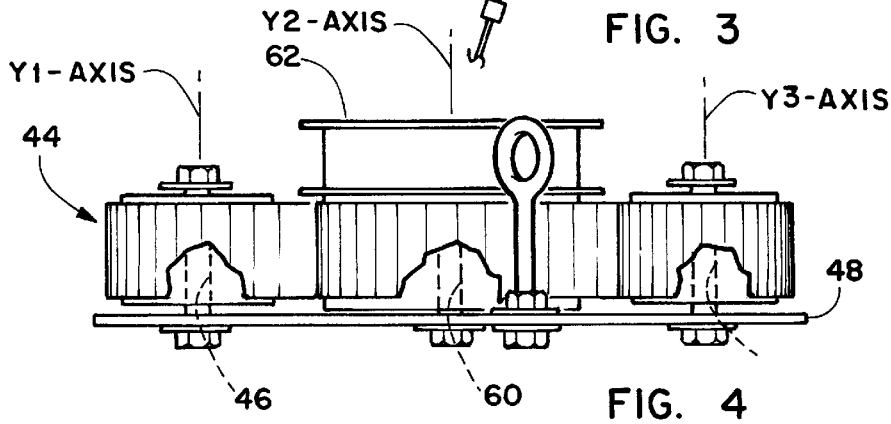
FIG. 4 is a front elevation view of the novel tensioning assembly with the cable being removed for clarity.

The inventor's novel floating reservoir cover tensioning system is illustrated in FIGS. 2–4. It is generally designated numeral 20 and it is installed on reservoir 22. Reservoir 22 has a concrete ring wall 24 located on the horizontal upper surface of the reservoir and it extends around the entire periphery thereof. A concrete overflow and reservoir inflation structure 26 with a stairway is positioned along one of the inner sloping surfaces of the reservoir. Floating cover 28 is supported on the top surface of the water and it has a plurality of access hatches 30 and a plurality of surface water cover drains 31. Floating cover 28 has a central portion 35 having a peripheral edge 36. Central portion 35 has at least 500 square feet of surface area. A skirt portion 38 surrounds central portion 35 and it has an inner peripheral edge 39 and an outer peripheral edge 40. Numerous cover tensioning stations 42 are positioned on the upper surface of the containing wall 12 of the reservoir. The cover tensioning stations 42 are separated from each other by a distance D1 and D1 is never greater than 30 feet.

FIG. 3 is a top plan view of one of the tensioning assemblies 42 with its cover 43 removed. A first spring motor drum 44 has a Y1-axis and it is journaled on a bearing shaft 46 extending upwardly from mounting plate 48. A constant force spring 50 has its rear end gripp ing the first spring motor drum 44. A second spring motor drum 52 has a Y3-axis and it is journaled on a bearing shaft 54 extending upwardly from mounting plate 48. A storage drum 58 has a Y2-axis and it is mounted on a bearing shaft 60 extending upwardly from mounting plate 48. A cable drum 62 is stacked on storage drum 58 and it is secured thereto so that they rotate as a single unit. A cable 66 has its one end secured to cable drum 62 and its free end passes through a cable guide 68 (such as an eye bolt) and is then secured to the floating cover. A stop member 69 limits the travel of cable 66 onto cable drum 62. The front end of constant force springs 50 and 55 are secured to the outer drum surface of storage drum 58.

What is claimed is:

1. A floating reservoir cover tensioning system comprising:

a reservoir having a surrounding containing wall that has an upper surface;

a floating cover having a central portion having a peripheral edge; said central portion having at least 500 square foot of surface area;

a skirt portion surrounds said central portion and it has an inner peripheral edge and an outer peripheral edge;

numerous cover tensioning stations are positioned on the upper surface of the containing wall of said reservoir; said cover tensioning stations being separated from each other by a distance D1 and D1 is never greater than thirty feet;

a plurality of tensioning assemblies for said floating cover, each tensioning assembly comprising: a cable drum having an outer drum surface and a perpendicularly oriented Y2-axis; a storage drum having an outer drum surface and a perpendicularly oriented Y2-axis; means connecting said cable drum to said storage drum so that their respective axes are co-axially aligned and they can rotate as a single unit; a first spring motor drum having an outer drum surface and a perpendicularly oriented Y1-axis; a first coiled-band spring formed of a strip of metal having a first end, a rear end, a width W1 and a length L1; said rear end of said first coiled-band spring gripping said first spring motor drum so that it can be coiled thereon and said front end of said first coiled-band spring being secured to said storage drum so that it can be coiled thereon; said first spring motor drum being journaled on a first bearing structure; said combined structure of said cable drum and said storage drum being journaled on a second bearing structure; and means at said respective tensioning stations for supporting said first spring motor drum and said combined structure of said cable drum and said storage drum; a cable having a predetermined length L3, a front end and a rear end; said rear end of said cable being secured to said cable drum so that it can be coiled thereon; and means for securing the outer peripheral edge of the skirt portion of said floating cover to the rear end of said cables extending from said tensioning assemblies at said respective cover tensioning stations.

2. A floating reservoir cover tensioning system as recited in claim 1 wherein L1 is in the range of 1–30 feet.

3. A floating reservoir cover tensioning system as recited in claim 1 wherein W1 is in the range of 1–6 inches.

4. A floating reservoir cover tensioning system as recited in claim 1 wherein said first coiled-band spring is a constant force spring.

5. A floating reservoir cover tensioning system as recited in claim 1 wherein said means at said respective tensioning stations for supporting said first spring motor drum and said combined structure of said cable drum and said storage drum is a mounting plate having a length L2 and a width W2.

6. A floating reservoir cover tensioning system as recited in claim 5 further comprising a cover for each of said tensioning assemblies.

7. A floating reservoir cover tensioning system as recited in claim 1 wherein each of said tensioning assemblies has means for guiding said respective cables onto said respective cable drums.

8. A floating reservoir cover tensioning system as recited in claim 7 wherein each of said cables has a stop member on it that limits how much of said respective cables can be wound on said respective cable drums.

9. A floating reservoir cover tensioning assembly as recited in claim 1 further comprising said tensioning assembly having a second motor drum having an outer drum surface and a perpendicularly oriented Y3-axis; a second coiled-band spring formed of a strip of metal having a front end, a rear end, a width W1 and a length L1; said rear end of said second coiled-band spring gripping said second spring motor drum so that it can be coiled thereon and said front end of said second coiled-band spring being secured to said storage drum so that it can be coiled thereon; and said second spring motor drum being journaled on a third bearing structure.

10. A plurality of tensioning assemblies, each tensioning assembly comprising: a cable drum having an outer drum surface and a perpendicularly oriented Y2-axis; a storage drum having an outer drum surface and a perpendicularly oriented Y2-axis; means connecting said cable drum to said storage drum so that their respective axes are co-axially aligned and they can rotate as a single unit; a first spring motor drum having an outer drum surface and a perpendicularly oriented Y1-axis; a first coiled-band spring formed of a strip of metal having a first end, a rear end, a width W1 and a length L1; said rear end of said first coiled-band gripping said first spring motor drum so that it can be coiled thereon and said front end of said first coiled-band spring being secured to said storage drum so that it can be coiled thereon; said first spring motor drum being journaled on a first bearing structure; said combined structure of said cable drum and said storage drum being journaled on a second bearing structure; and means at said respective tensioning stations for supporting said first spring motor drum and said combined structure of said cable drum and said storage drum; a cable having a predetermined length L3, a front end and a rear end; said rear end of said cable being secured to said cable drum so that it can be coiled thereon; and means for securing the outer peripheral edge of the skirt portion of a floating cover to the front end of a cable extending from a tensioning assembly at a cover tensioning station.

11. A floating reservoir cover tensioning assembly as recited in claim 10 further comprising said tensioning assembly having a second motor drum having an outer drum surface and a perpendicularly oriented Y3-axis; a second coiled-band spring formed of a strip of metal having a front end, a rear end, a width W1 and a length L1; said rear end of said second coiled-band spring gripping said second spring motor drum so that it can be coiled thereon and said front end of said second coiled-band spring being secured to said storage drum so that it can be coiled thereon; and said second spring motor drum being journaled on a third bearing structure.

* * * * *